US009583875B2

(12) United States Patent
Griepenstroh

(10) Patent No.: US 9,583,875 B2
(45) Date of Patent: Feb. 28, 2017

(54) PLUG CONNECTOR WITH TWO TYPES OF LOCKING DEVICES

(71) Applicant: HARTING Electric GmbH & Co. KG, Espelkamp (DE)

(72) Inventor: Sebastian Griepenstroh, Luebbecke (DE)

(73) Assignee: HARTING ELECTRIC GMBH & CO. KG (DE)

( * ) Notice: Subject to any disclaimer, the term of this patent is extended or adjusted under 35 U.S.C. 154(b) by 0 days.

(21) Appl. No.: 14/912,053

(22) PCT Filed: Oct. 16, 2014

(86) PCT No.: PCT/DE2014/100370

§ 371 (c)(1),
(2) Date: Feb. 12, 2016

(87) PCT Pub. No.: WO2015/058740

PCT Pub. Date: Apr. 30, 2015

(65) Prior Publication Data

US 2016/0226186 A1 Aug. 4, 2016

(30) Foreign Application Priority Data

Oct. 25, 2013 (DE) ..... 10 2013 111 760

(51) Int. Cl.
*H01R 4/50* (2006.01)
*H01R 13/625* (2006.01)
(Continued)

(52) U.S. Cl.
CPC ..... *H01R 13/62927* (2013.01); *H01R 13/436* (2013.01); *H01R 13/639* (2013.01); *H01R 43/26* (2013.01)

(58) Field of Classification Search
CPC ..... H01R 13/62927; H01R 13/436; H01R 13/639; H01R 43/26; H01R 12/88
(Continued)

(56) References Cited

U.S. PATENT DOCUMENTS 3,617,985 A * 11/1971 Kehl ..... H01R 23/10 439/341
4,082,400 A * 4/1978 Gansert ..... H01R 13/436 439/341
(Continued)

FOREIGN PATENT DOCUMENTS

CH 415786 6/1966 ..... H01R 27/02
DE 2354795 5/1975 ..... H01R 13/436
(Continued)

OTHER PUBLICATIONS

International Search Report and Written Opinion issued in application No. PCT/DE2014/100370, dated Jan. 26, 2015 (12 pgs).
(Continued)

*Primary Examiner* — Hae Moon Hyeon
(74) *Attorney, Agent, or Firm* — Hayes Soloway P.C.

(57) ABSTRACT

Provided is a plug connector for connecting electrical lines. The plug connector comprises a first plug connector housing and a second plug connector housing which can be plug-connected and locked to one another. The plug connector housings have two types of locking devices for locking purposes. In this case, the first type of locking device forms, from a rotary pin and a rotary bearing, a rotation axis about which the plug connector housings are mounted such that they can rotate in relation to one another. The second type of locking device is a type which is known from the prior art and which serves to fix the first plug connector housing to the second plug connector housing.

10 Claims, 5 Drawing Sheets

(51) Int. Cl.

| | |
|---|---|
| ***H01R 13/629*** | (2006.01) |
| ***H01R 13/436*** | (2006.01) |
| ***H01R 13/639*** | (2006.01) |
| ***H01R 43/26*** | (2006.01) |

(58) Field of Classification Search
USPC ..... 439/341, 694
See application file for complete search history.

(56) References Cited

U.S. PATENT DOCUMENTS

| | | | | |
|---|---|---|---|---|
| 4,869,681 | A * | 9/1989 | Vache | H05K 7/1461 439/341 |
| 4,877,409 | A | 10/1989 | Tanigawa et al. | 439/31 |
| 5,253,140 | A | 10/1993 | Inoue et al. | 361/728 |
| 5,487,677 | A | 1/1996 | Hoffner | 439/293 |
| 6,217,360 | B1 * | 4/2001 | Parent | H01R 13/6215 439/341 |
| 6,332,795 | B1 * | 12/2001 | Conorich | H01R 13/62933 439/188 |
| 6,692,316 | B2 | 2/2004 | Hsieh et al. | 439/845 |
| 6,910,911 | B2 * | 6/2005 | Mellott | H01R 13/2421 439/180 |
| 7,722,377 | B2 * | 5/2010 | Moore | H01R 13/6392 439/341 |
| 7,963,790 | B1 * | 6/2011 | Winter, Jr. | H01R 13/055 439/264 |

FOREIGN PATENT DOCUMENTS

| | | | |
|---|---|---|---|
| DE | 3634695 | 4/1988 | H01R 13/627 |
| DE | 3744277 | 7/1988 | H01R 13/645 |
| DE | 9218952 | 5/1996 | H01R 13/28 |
| FR | 2702889 | 9/1994 | H01R 13/436 |
| JP | 2011049099 | 3/2011 | H01R 13/46 |
| WO | WO2012104172 | 8/2012 | H01R 13/629 |

OTHER PUBLICATIONS

German Office Action issued in application No. 10 2013 111 760.0, dated Jun. 27, 2014 (7 pgs).
International Preliminary Report on Patentability issued in application No. PCT/DE2014/100370, dated Apr. 28, 2016(8 pgs).

* cited by examiner

PLUG CONNECTOR WITH TWO TYPES OF LOCKING DEVICES

FIELD OF THE INVENTION

The invention relates to a plug connector with two interconnectable homing parts.

BACKGROUND OF THE INVENTION

Plug connectors of this type are needed to connect a signal- or power-conveying cable to a device or a machine. Devices or machines of this type are preferably motors, to which reference will be made hereinafter.

However, the invention can also be transferred to other devices, machines and apparatuses, and is not limited exclusively to motors.

The purpose of plug connectors of this type is to connect all lines or cores of the cable to connection points in a motor. Here, plug connectors preferably consist of two corresponding interconnectable housing parts.

A first of the housing parts is intended to receive the cable. The lines or cores of the cable guided into the housing are provided with contact means, which are secured in the housing and—in the case of electrical lines—are electrically insulated with respect to one another.

The second housing part, which is also known as an add-on housing, is provided on the motor and connected thereto. The connection points of the motor are likewise connected to contact means in the second housing part.

By mechanically connecting the two housing parts of the plug connector, the received contact means are interconnected and produce a conductive connection between the cable and the connection points of the motor.

DESCRIPTION OF THE PRIOR ART

Many plug connectors, consisting of an add-on housing and a corresponding plug, are known from the prior art. These can also be used expediently for the connection of a motor or other devices.

An electrical plug element for an electrical plug connection is known from WO 2012/104172 A1, comprising a conductor-receiving portion for receiving at least one electrical conductor, and a cap, which in an installed position at least partially with the conductor-receiving portion and/or the conductor.

DE 36 34 695 A1 discloses a multi-pole electrical plug apparatus, consisting of a plug and a plug socket having housings made of plastic, which can be connected by means of a pivot joint connection. Here, contacts are received, to which lines are connected. A detent connection is provided for the locking of the plugged apparatus.

DE 37 44 277 A1 presents a multi-pole plug connector having a socket part and a plug part, which can be latched to one another, wherein, as a result of the latching, a pivot joint is produced for plugging together the normally open contacts of the socket part and of the plug part in an accurately positioned manner. It is proposed to arrange a coding of the socket part and of the plug part in each case between the pivot joint and the normally open contacts in order to prevent the normally open contacts from being brought into engagement with one another in the event that the socket part and plug part do not fit one another.

A hinged electronic plug connector for printed circuit boards is known from U.S. Pat. No. 4,877,409. The plug connector consists of two plug-in parts, which can be contacted in a hinged manner by means of pins and pockets.

JP 2011-049099 A presents a cable connection structure consisting of a connector head and a socket contact, which is received in a housing and can be contacted with the connector head. For this purpose, the housing is provided with openings, into which the contacts of the connector head can be inserted and can contact the socket contacts in the housing.

A disadvantage that is shared by the known plug connectors is that they are very tall. This means that a plug connector of this type extends very far away from the surface on which said plug connector is mounted. The plug connectors thus have a very large overall height.

This property has an adverse effect particularly when for example the motor connected to the plug connector is used in a very confined environment of limited space. Here, connections and plug connectors on the motor that are very space saving are helpful.

BRIEF SUMMARY OF THE INVENTION

The problem addressed by the invention lies in providing a plug connector for the connection of devices and machines, which plug connector is characterized by a very short overall height. Besides the overall height, the plugging process should also be space saving with respect to the space in which the plug connector parts are moved.

The invention relates to a plug connector for producing a conductive connection. Here, the conductive connection may be of electrical, pneumatic, fluid or also optical nature. A different medium can be transferred depending on the application.

The present invention, in its primary application, relates to the connection of electrical conductors and the transfer of electricity. This, however, does not exclude the transfer of the invention to other media.

The plug connector naturally consists of two plug-in partners, which can be coupled to one another. These are constituted by a first plug connector housing, which is intended for the connection of a cable, and a second plug connector housing, which is intended for assembly on a device, a machine, or another housing.

The first plug connector housing has a connection point for the cable, wherein the connection point, as known in the prior art, preferably consists of a cable gland. The cable gland allows the cable to be introduced into the plug connector housing. At the same time, the cable gland mechanically fixes the cable to the first plug connector housing. The known cable glands additionally seal off the housing interior with respect to the infiltration of dirt and moisture.

At least one insulating body having contact means received therein is provided in the interior of the plug connector housing, which preferably is produced from metal. Here, the insulating body serves to insulate the contact means with respect to one another.

The contact means, which are expediently formed as contact pins or contact sockets, are each connected to a core or a conductor of the cable that is guided into the plug connector housing. This allows the individual, electrical signals of the cable to be forwarded to the second plug-in partner via the contact means.

In a particular embodiment of the invention the contact means are embodied as dual-contactable contact means. This means that the contact means are formed both as contact pin and as contact socket.

Here, the contact means have, at the front end thereof, a shaping as contact pin. In the middle region of the contact means, a bore is provided, which makes it possible to contact a contact pin with the contact means. The bore is preferably oriented at an angle of approximately 90° to the plug-in direction of the contact pin on the front side.

This special embodiment of the contact means serves on the one hand for component reduction, since one type of contact means can be used in a plug connector. In addition by way of example, besides the contacting of a further contact means, the plug connector housing can also be contacted at the same time using a contact means of this type.

In the case of metal housings, the earthing required can thus be transferred from the cable to the housing.

There is no need for any additional contacting by means of a screw connection or a shield ring on the cable gland.

The second plug connector housing is likewise intended to receive at least one insulating body and contact means received therein. As already explained, it is possible to dispense with a second type of contact means by expedient arrangement of the contact means in the plug connector housings. Merely one type of contact means—which have a contact pin and a contact socket—is required for the plug connector.

The two plug connector housings can be joined to one another in each case on an open side. The contact means are arranged in the plug connector housings such that, when the plug connector housings are joined together, the contact means thereof are mechanically and electrically contacted.

In accordance with the invention the two plug connector housings have at least two types of locking means. The locking means make it possible to permanently lock together the plug connector housings in the contacted state, such that the plug connection cannot be opened by unintended, mechanical external influences.

The first type of locking means is characterized in that at least one, preferably two rotary pins are integrally formed on one of the plug connector housings. These rotary pins engage with rotary bearings on the other plug connector housing. The plug connector housings are hooked to one another by means of the rotary pins in the rotary bearings and form the first type of locking means.

The rotary pins together with the rotary bearings additionally form an axis of rotation, which makes it possible to move the two plug connector housings relative to one another about the axis of rotation. The plug connector can be closed or opened as a result of this tilting motion.

In addition, the plug connector has at least one second type of locking means. This makes it possible to lock together the plug connector housings of the closed plug connector such that a tilting of the plug connector housings about the axis of rotation is no longer possible. The opening of the plug connector is thus prevented.

The second type of locking means can be formed here by different technical solutions. By way of example, a screw connection of the two plug connector housings is thus conceivable. A bayonet closure or a locking lever, as is known from the field of heavy duty plug connectors would also be expedient.

BRIEF DESCRIPTION OF THE DRAWINGS

An exemplary embodiment of the invention is illustrated in the drawings and will be explained in greater detail hereinafter. In the drawings.

The figures contain partially simplified, schematic illustrations. Like reference signs are sometimes used for like, but potentially non-identical elements. Different views of the same elements could be scaled differently.

DETAILED DESCRIPTION OF THE INVENTION

Figure 1:
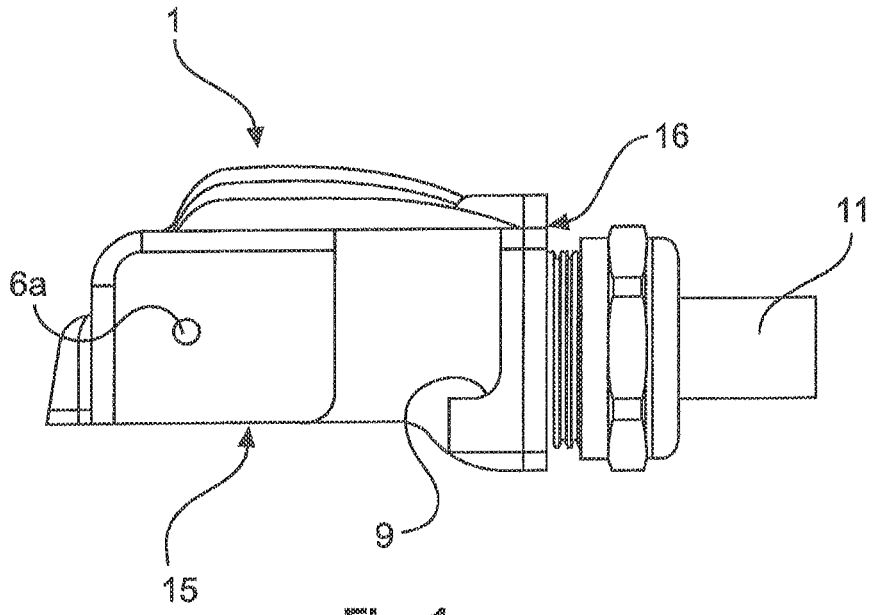
FIG. 1 shows a first plug connector housing.
Figure 3:
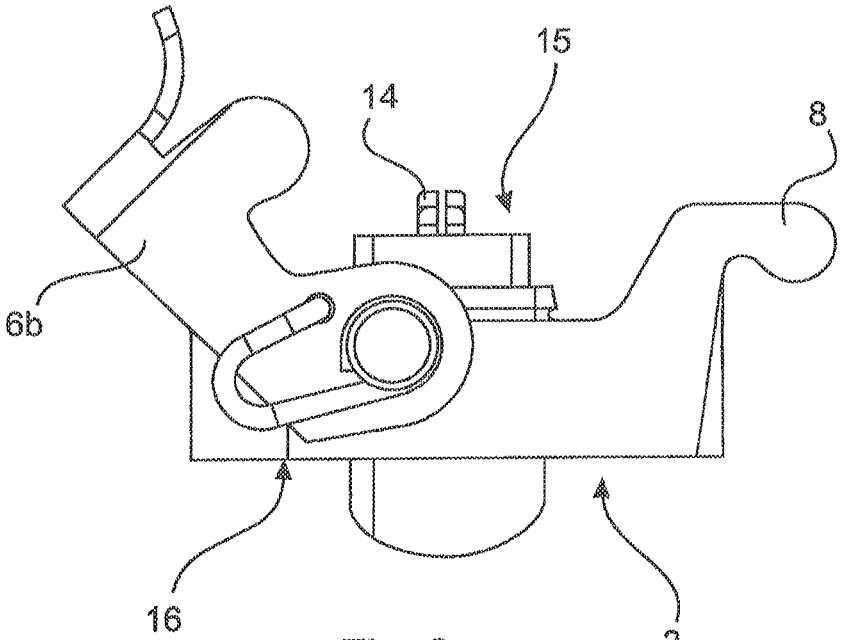
FIG. 3 shows a second plug connector housing.

FIG. 1 shows a first plug connector housing 1 in a side view. The component produced as a hollow body by means of diecasting has, on its underside, an opening serving as a plug-in region 15. The plug connector housing 1 can be contacted in this plug-in region 15 with a second plug connector housing 2 (FIG. 3).

In addition, the plug connector housing 1 has a connection region 16. The connection region 16 is formed in this exemplary embodiment as a cable gland. A cable 11 is received in the cable gland and is guided into the plug connector housing 1 via the connection region 16.

In this particularly advantageous embodiment the plug-in region 15 and connection region 16 of the plug connector housing 1 are arranged at approximately 90° relative to one another. This means that the connection region 16 is arranged on a side of the plug connector housing 1 directly adjoining the plug-in region 15. This arrangement of plug-in region 15 and connection region 16 is particularly space-saving. A very flat design of the plug connector is thus made possible.

Figure 2:
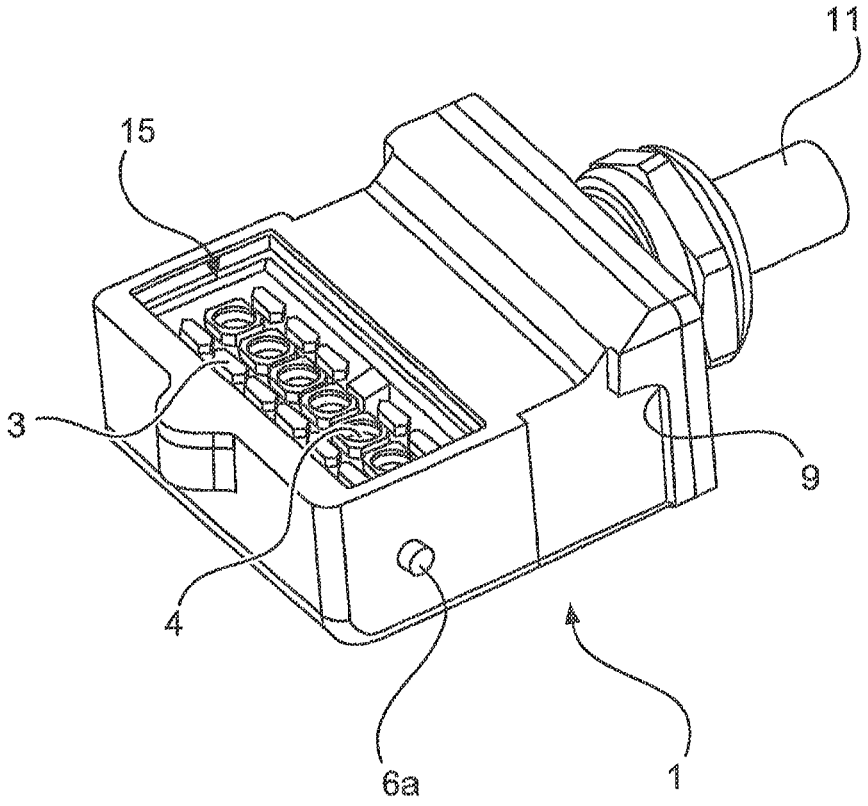
FIG. 2 shows a first plug connector housing in a three-dimensional view showing the plug-in region.

The first plug connector housing 1 from FIG. 1 is illustrated again in FIG. 2, but in a three-dimensional view showing the plug-in region 15. The open plug-in region 15 makes it possible to see an insulating body 3 arranged in the plug connector housing 1.

The insulating body 3 in this exemplary embodiment has six contact chambers, in each of which one contact means 4 is received. The contact means 4 are each connected to a core of the cable 11 guided into the plug connector housing 1.

FIG. 3 shows a second plug connector housing 2 corresponding to the first plug connector housing 1. The second plug connector housing 2 embodied as an add-on housing likewise has a plug-in region 15 and a connection region 16.

The plug-in region 15 of the second plug connector housing 2 is compatible for plugging to the plug-in region 15 of the first plug connector housing 1. The plug connector housings 1, 2 can thus be connected to one another in an interlocking manner at the plug-in regions 15 thereof.

The connection region 16 of the second plug connector housing 2 is formed as an open region. It allows the plug connector housing 2 to be fitted onto a device, housing or a machine 10 as what is known as an add-on housing. Lines can be guided through an opening in the device, the housing or the machine 10 into the plug connector housing 2 placed over said opening.

Likewise, as in the first plug connector housing 1, an insulating body 13 is provided in the second plug connector housing 2 and is received in the plug connector housing 2. The design as an add-on housing makes it possible to allow the insulating body 13 to protrude from the plug connector housing 2 via the connection region 16. The part of the insulating body 13 no longer located in the plug connector housing 2 is received by the device, housing or the machine 10 on which the plug connector housing 2 is mounted.

The lines guided into the plug connector housing 2 are connected to contact means 14, as is also the case in the first plug connector housing 1. These lines are received in the insulating body 13. However, in contrast to the first plug connector housing 1, the contact means 14 protrude from the insulating body 13, such that, when the plug connector is closed, they dip into the insulating body 3 of the first plug connector housing 1 and may contact the contact means 4 received there.

Figure 4:
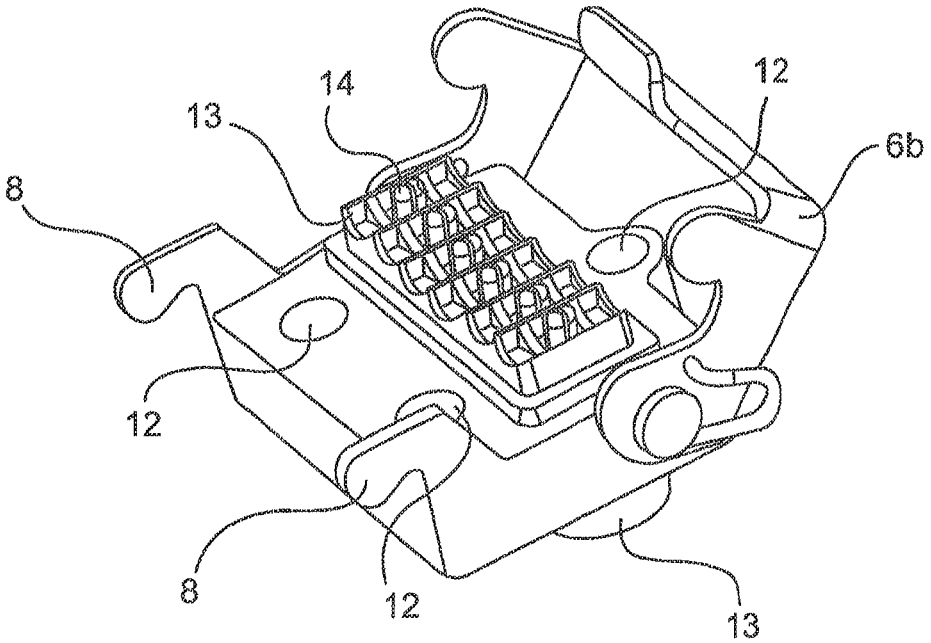
FIG. 4 shows a second plug connector housing in a three-dimensional view showing the plug-in region.

The second plug connector housing 2 from FIG. 3 is illustrated again in FIG. 4, but in a three-dimensional view showing the plug-in region 15. The six contact means 14 received in the insulating body 13 can be seen.

In addition, securing bores 12 are integrally formed in the second plug connector housing 2, by means of which bores the plug connector housing 2 can be secured on a device, housing or a machine 10. By way of example, screws are expedient for this purpose. However, it is also conceivable to secure the plug connector housing 2 using rivets.

Figure 5:
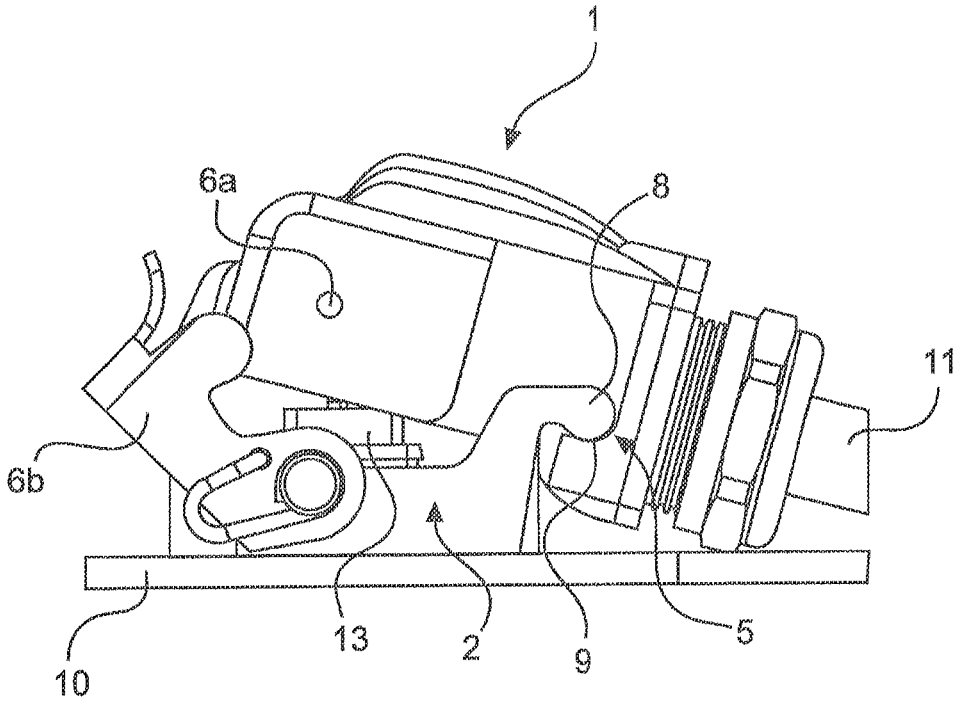
FIG. 5 shows a plug connector according to the invention in the open state.

The first plug connector housing 1 and the second plug connector housing 2 together form the plug connector according to the invention, which is illustrated in FIG. 5 in an open state. The second plug connector housing 2 is secured on a device 10.

In accordance with the invention the plug connector has two types of locking means 5, 6, which serve to lock the two plug connector housings 1, 2. The first type of locking means 5 is formed from a rotary pin 8 on the second plug connector housing 2, and a rotary bearing 9 on the first plug connector housing 1.

The plug connector housings 1 and 2 have two rotary bearings 9 and rotary pins 8 respectively. In a further embodiment it would also be conceivable to form the rotary bearings 9 on the second plug connector housing and to form the rotary pins 8 on the first plug connector housing 1.

In the position of the plug connector housings 1, 2 illustrated in FIG. 5 the rotary pins 8 engage with the rotary bearings 9. An axis of rotation 7 is thus formed, about which the first plug connector housing 1 can be pivoted. At the same time, the rotary pins 8 in conjunction with the rotary bearings 9 prevent the plug connector from being opened in the closed state.

As a result of this type of locking means 6 and the rotary movement for opening and closing, a type of plug connector that saves space and room is made possible in a particularly advantageous manner.

Figure 6:
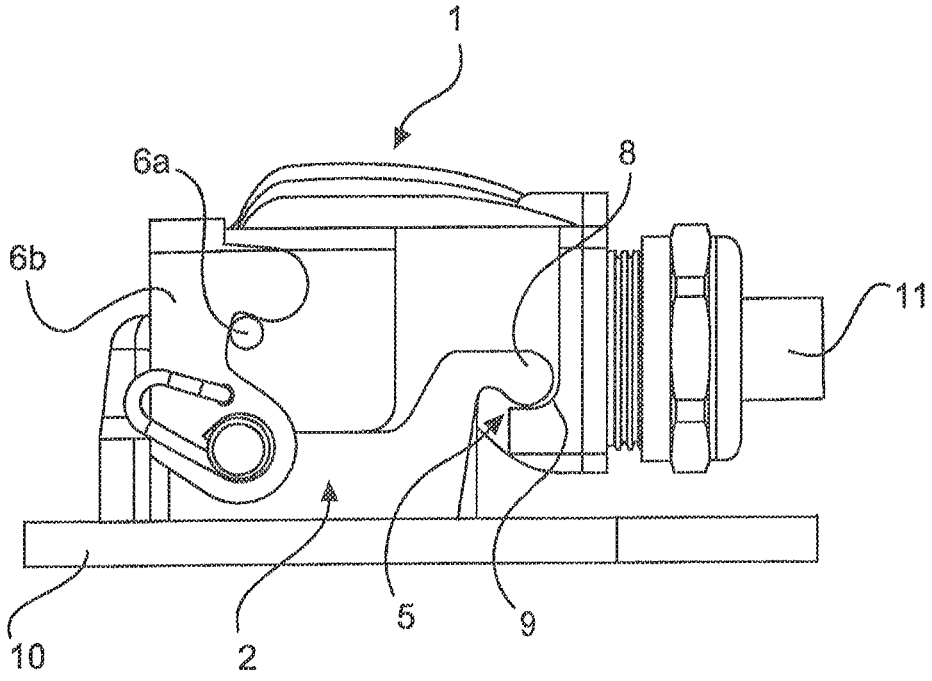
FIG. 6 shows a plug connector according to the invention in the closed and locked state.

FIG. 6 shows the plug connector in a closed, completely locked state. Besides the first type of locking means 5 (rotary pin 8 and rotary bearing 9), the plug connector is locked by means of the second type of locking means 6. In this exemplary embodiment the second type of locking means 6 is formed by a locking clip **6*b* and locking pin 6*a***. These are known in many cases from the prior art from the field of heavy-duty plug connectors.

The locking clip **6*b* is rotatably secured to the second plug connector housing 2. By pivoting the locking clip 6*b*, this engages with a locking pin 6*a* on the first plug connector housing 1**. The plug connector can therefore no longer be opened.

The second type of locking means 6 can also be formed differently. By way of example, FIG. 7 thus shows a plug connector according to the invention in a three-dimensional view, wherein the second type of locking means 6 is formed by a screw. The first plug connector housing 1 and the second plug connector housing 2 are screwed together by means of said screw.

An embodiment of the screw as a bayonet closure would also be conceivable. This would have the advantage that said screw would not have to be rotated a number of times until ultimate fixing is achieved. Merely a quarter or half turn—depending on the design of the bayonet closure—would be necessary in order to lock the plug connector.

Figure 7:
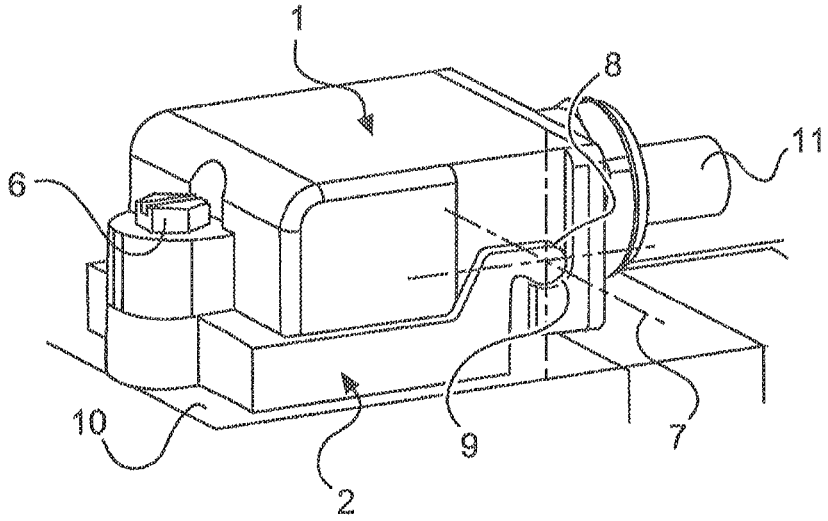
FIG. 7 shows a further plug connector according to the invention in the closed and locked state.

The axis of rotation 7 formed by the rotary pins 8 and the rotary bearings 9 is additionally shown in FIG. 7. The first plug connector housing 1 can be rotated about this axis of rotation 7 in order to open the plug connector, which is closed here.

Figure 8:
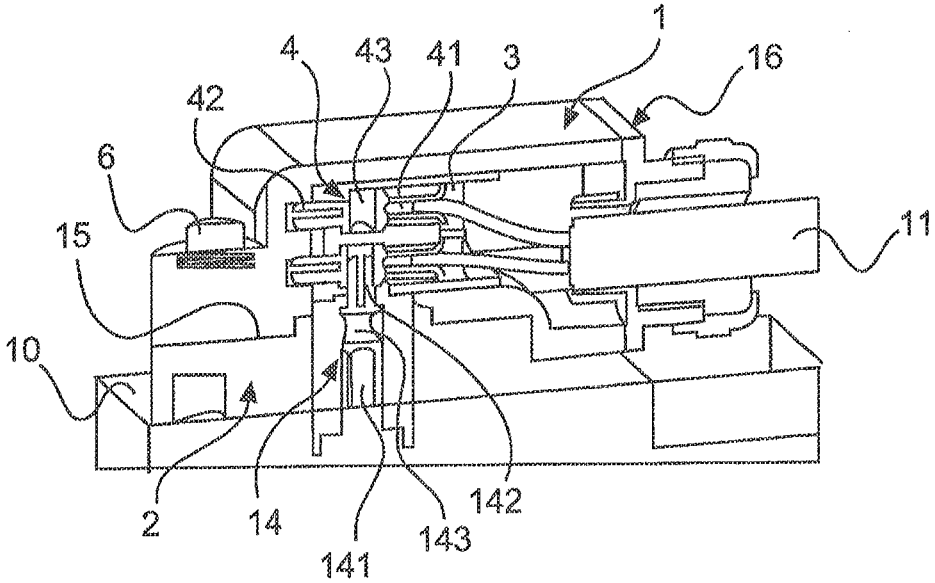
FIG. 8 shows the plug connector from FIG. 7 in a sectional illustration.

FIG. 8 shows the plug connector from FIG. 7 in a completely sectional view. The cable 11 is introduced into the plug connector housing 1 at the right-hand connection region 16 of the plug connector housing 1. The cable 11 is split in the plug connector housing 1 into its individual cores, which are each connected to a cable connection region 41 of the contact means 4.

The cable connection region 41 of the contact means 4 may be formed here as a crimp, screw, solder or clamp connection. Another technique may be advantageous here depending on the dimension and type of cable cores.

The contact means 4 each have a cable connection region 41, a first contact region 42, and a middle second contact region 43. The first contact region 42 is formed here as a pin contact, wherein the middle second contact region 43 is formed as a socket contact.

The contact means 14 of the second plug connector housing 2 are oriented tangentially in relation to the axis of rotation 7 (see FIG. 7) and are formed identically to the contact means 4, such that advantageously only one type of contact means 4, 14 can be installed in the plug connector.

The way in which the plug-in regions 15 of the plug connector housings 1, 2 engage with one another in an interlocking manner can be seen in the shown sectional illustration.

The contact means 14 each have a cable connection region 141, a first contact region 142, and a middle second contact region 143. The first contact regions 142 of the contact means 14 of the second plug connector housing 2 penetrate the middle second contact regions 43 of the contact means 4 of the first plug connector housing 1.

In this special embodiment of the plug connector, however, the contact means 4 of the first plug connector housing 1 serve not only to contact the contact means 14. It can be seen in the sectional view that the first contact regions 42 additionally contact the metal plug connector housing 1 for earthing purposes. A protective earthing conveyed via cores of the cable 11 can thus be directly connected to a metal plug connector.

Figure 9:
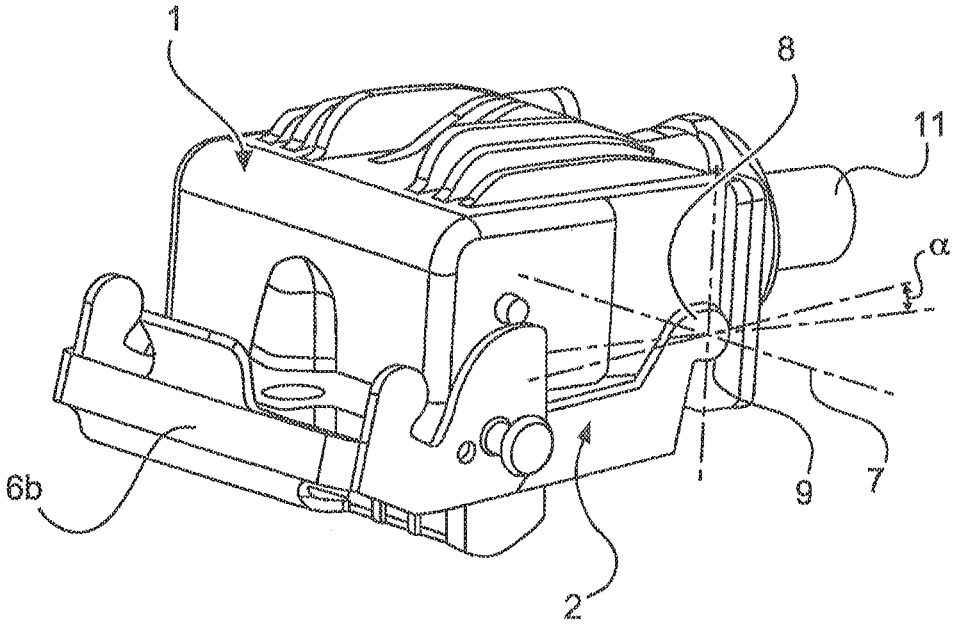
FIG. 9 shows a further embodiment of the plug connector.

FIG. 9 shows a further expedient embodiment of the plug connector according to the invention. In this embodiment the locking clip **6*b*, which together with the locking pin 6*a* forms the second locking means 6, is shaped in the manner of a segment of a circle. By means of this shaping, the locking pin 6***a* is raised as the locking clip 6*b* is opened.

The plug connector can thus be opened by a certain angle α. This is helpful particularly in areas of use in which space is restricted. If the plug connector cannot be opened by hand or if there is not enough space to grasp the plug connector, said plug connector is opened at least in part, which facilitates a complete opening of the plug connector by hand.

LIST OF REFERENCE SIGNS

1 first plug connector housing
2 second plug connector housing
3 insulating body
4 contact means
5 locking means of first type
6 locking means of second type
6*a* locking clip
6*b* locking pin
7 axis of rotation
8 rotary pin
9 rotary bearing
10 device/housing/machine
11 cable
12 securing bore
13 insulating body
14 contact means
15 plug-in region
16 connection region
41/141 cable connection region
42/142 first contact region
43/143 second contact region

The invention claimed is:

1. A plug connector, comprising a first plug connector housing, which can be connected as a plug to a cable, and a second, corresponding plug connector housing, which can be assembled as an add-on housing on a device or housing, wherein insulating bodies and contacts received therein are arranged in the plug connector housings, wherein two types of locking devices are configured for reciprocal locking of the plug connector housings, wherein at least one rotary pin is provided on one of the plug connector housings and at least one corresponding rotary bearing is provided on the other plug connector housing and the at least one rotary pin and the at least one rotary bearing form an axis of rotation, about which the plug connector housings can move relative to one another, wherein the contacts have a cable connection region, a first contact region, and a middle second contact region arranged between the cable connection region and the first contact region, wherein the first contact region is formed as a pin contact and the second contact region is formed as a socket contact, and wherein the first contact regions of the contacts are compatible for plugging to the second contact regions of the contacts.

2. The plug connector as claimed in claim 1, wherein the at least one rotary pin engages with the least one rotary bearing and thus forms the first type of locking device.

3. The plug connector as claimed in claim 2, wherein the second type of locking device is formed by a screw, a bolt, a bayonet closure, a latched connection or a locked connection.

4. The plug connector as claimed in claim 1, wherein the contacts of the first plug connector housing are oriented at an angle of approximately 90° to a plug-in direction and to the contacts of the second plug connector housing.

5. The plug connector as claimed in claim 1, wherein the contacts of the first plug connector housing are oriented radially in relation to the axis of rotation, and the contacts of the second plug connector housing are oriented tangentially in relation to the axis of rotation.

6. The plug connector as claimed in claim 1, wherein the first contact region of the contacts are oriented at an angle of approximately 90° to the second contact region.

7. The plug connector as claimed in claim 1, wherein at least one of the contacts of the first plug connector housing contacts the first plug connector housing via the first contact region.

8. The plug connector as claimed in claim 1, wherein the contacts of the first plug connector housing, in the second contact region, contacts the first contact regions of the contacts of the second plug connector housing.

9. The plug connector as claimed in claim 1, wherein the cable connection region is formed as a crimp, screw, solder or clamp connection.

10. A method for contacting a plug connector having two plug connector housings as claimed in claim 1, comprising the following steps:

orienting the plug connector housings at an angle between 0° and 90° to one another, hooking rotary pins of one plug connector housing into rotary bearings of the other plug connector housing, tilting the plug connector housings relative to one another about an axis of rotation, which is defined by the rotary pins and the rotary bearings, until the plug connector housings bear fully against one another, and locking the plug connector housings to one another by means of a locking device.

* * * * *